United States Patent [19]

Romano

[11] 3,993,882

[45] Nov. 23, 1976

[54] MICRO-MINIATURE MERCURY TILT-TYPE INERTIA SWITCH

[75] Inventor: Robert P. Romano, Glen Ridge, N.J.

[73] Assignee: The Gordos Corporation, Bloomfield, N.J.

[22] Filed: Oct. 7, 1975

[21] Appl. No.: 620,400

[52] U.S. Cl. ..... 200/220; 200/61.47

[51] Int. Cl.[2] ..... H01H 29/20

[58] Field of Search ..... 200/220, 182, 223, 224, 200/225, 226, 227, 228, 229, 61.47

[56] References Cited

UNITED STATES PATENTS

| | | | |
|---|---|---|---|
| 1,805,277 | 5/1931 | Cramblet | 220/220 |
| 1,933,323 | 10/1933 | Fagan | 200/220 |
| 1,993,045 | 3/1935 | Warnke | 220/220 |
| 2,130,500 | 9/1938 | Lawson | 200/220 |
| 3,755,643 | 8/1973 | Blair | 200/220 |

*Primary Examiner*—Herman Hohauser
*Attorney, Agent, or Firm*—Donald R. Heiner

[57] ABSTRACT

A micro-miniature mercury tilt-type inertia switch which may be utilized in a light-emitting, solid state, digital-display watch to activate a digital read-out circuit by a "flick-of-the-wrist" motion. The switch is normally in a closed position, i.e., a globule of mercury contacts both electrodes, and a tilt force of approximately 1.4 G's is required to open the circuit. A movement of the switch back to 2° or less below horizontal will reclose the circuit.

4 Claims, 3 Drawing Figures

MICRO-MINIATURE MERCURY TILT-TYPE INERTIA SWITCH

BACKGROUND OF THE INVENTION

1. Field of the Invention

The present invention relates to a mercury tilt type inertia switch in which contact is made and broken in response to the force of gravity acting upon a globule of mercury and on intectial force.

2. Description of the Prior Art

Present light-emitting, solid state watches use a push-button mechanism to activate the digital readout. When the push-button is released, the digital readout is deactivated, i.e., the watch face goes black. Clearly, both hands are needed to read the time on the watch and, in some cases, the push-button may not be released quickly enough to conserve battery power over a period of time.

SUMMARY OF THE INVENTION

It is, therefore, an object of the present invention to provide a mercury tilt-type inertia switch which has a low tilt angle and a force requirement incorporated into one movement, to allow a specific motion to both activate and re-set the switch.

Toward the fulfillment of these objects, the present invention comprises a tilt-sensitive switch in which contact is made and broken in response to the force of gravity acting upon a globule of mercury and in which the globule of mercury remains permanently in contact with one electrode and normally in contact with both electrodes in a closed position, and when tilted from a close position by a flick-of-wrist movement, in which a force of approximatey 1.4 G is generated, the switch is opened. However, when the switch is in an open position, a tilt back to 2° or less below horizontal will cause the globule of mercury to immediately move axially and contact both electrodes to close the switch.

BRIEF DESCRIPTION OF THE DRAWINGS

Reference is now made to the accompanying drawings for a better understanding of the nature and objects of the present invention. The drawings illustrate the best mode presently contemplated for carrying out the objects of the invention and are not to be construed as restrictions or limitations on its scope. In the drawings.

DESCRIPTION OF THE PREFERRED EMBODIMENT

By preference, and not in limitation of the invention, and to facilitate high-speed production, the embodiment shown and described herein is of cylindrical external shape and all fabricated parts are of circular cross-section with electrical connections made at one end of the switch.

Figure 1:
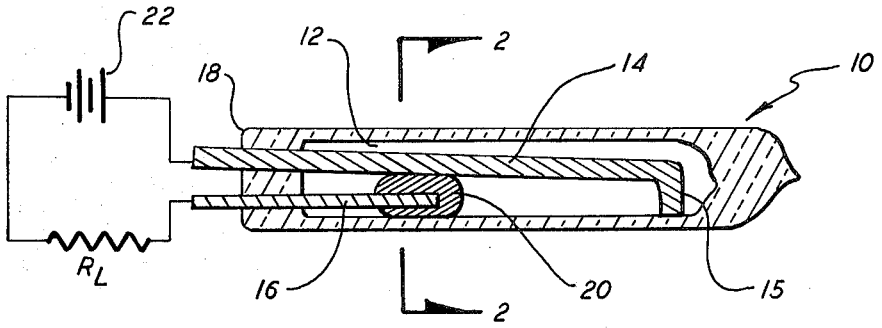
FIG. 1 is an axial sectional view of one form of the invention, this embodiment being a single throw switch in which contact is made only in response to a tilt in a single longitudinal direction and shown in its normally closed position.
Figure 2:
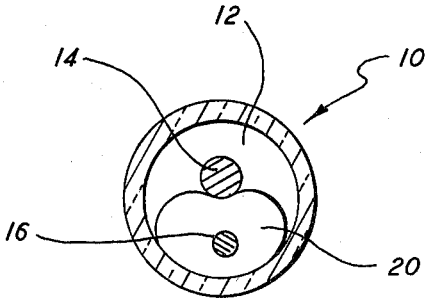
FIG. 2 is an enlarged vertical cross-sectional view, taken along line 2—2 of FIG. 1, of the invention.

Referring to FIG. 1 of the drawings, the mercury tilttype inertia switch of the present invention is shown by the reference numeral 10 and comprises a chamber 12 having a pair of electrode elements 14 and 16 of metal chemically inert with respect to mercury and rigidly mounted at one end 18 of the chamber, and a globule of mercury 20 cooperating with the electrodes in response to gravity forces.

Specifically, FIG. 1 shows the partially vacuumed switch chamber with its axis horizontally disposed and with the globule of mercury, not in section, shown in contact with both electrodes. The long electrode 14 extends substantially through the length of the chamber but not co-axially therewith, since tilted slightly downward with its end 15 but perpendicular thereto and in contact with the surface of the chamber. The short electrode extends into the chamber a predetermined length from the chamber end 18 with its axis coaxial to the axis of the chamber.

As disclosed above, the electrodes are fabricated of chemically inert metal relative to mercury; for example, the long electrode 14 may be fabricated from such metals as 52 alloy, molybdenum, tungsten, or the like, and the short electrode 16 fabricated from a noble metal such as platinum which is wetted with mercury to provide a holding action on the globule of mercury. The slightly tilted downward long electrode imposes a surface tension on the globule of mercury when not in contact with the short electrode.

FIG. 1 discloses a typical circuit associated with the switch 10, wherein a power supply 22, such as a 1.2 volt battery, and the resistance of the load $R_L$ are shown in series with the electrodes.

From the foregoing, several novel features are apparent. The switch 10 requires more than a 1 G force to open the circuit and a milli-G force to close it. The globule of mercury is always in contact with electrode 14, independent of the disposition of the switch, and in its normally closed position is in contact with electrode 16, as shown in FIG. 1. As previously disclosed, electrode 14 extends substantially through the switch chamber and slightly tilted downward placing a surface tension on the mercury globule when the switch is open. The bent end 15 of the long electrode which rests on the chamber bottom surface prevents any flow of mercury past the electrode end and eliminates the possibility of mercury sticking between the ends of the electrode and of the switch chamber.

Figure 3:
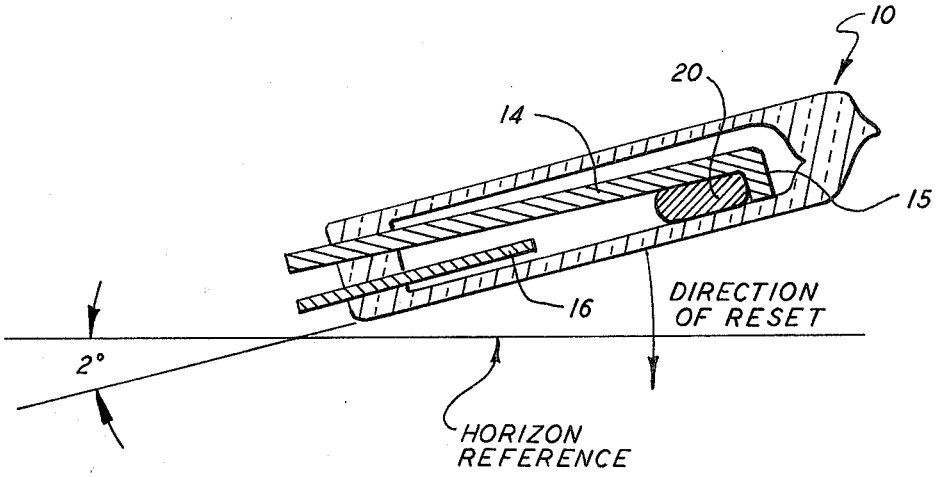
FIG. 3 is an axial sectional view of the embodiment of FIG. 1, showing the switch in its open position.

Normally the switch 10 is in a closed position, that is, the globule of mercury is in contact with the mercury-wetted platinum electrode 16 and bridges to the other electrode. The switch remains closed and any tilting of it does not roll the globule of mercury from the electrode 16 because of surface tension forces on the mercury as a result of the structural configuration of the switch. However, a tilt generating a force of 1.4 G, or more, will cause the globule of mercury to break from the short electrode and move toward the end 15 of the long electrode to open the switch. As illustrated in FIG. 3, a slight movement back of the switch, 2° or less from the horizontal, will reclose the switch since the globule of mercury has a tendency to flow toward the wider spacing between the electrodes, due to the surface tension, and contact both electrodes.

Generally, the switch is fabricated in subminiature proportions to fit, for example, in an electronic timepiece. A typical configuration would have the following dimensions: the diameter of the switch 0.070 inch and the overall length 0.400 inch, the diameter of the long electrode .018 inch and of the short electrode .010 inch, and the length within the chamber 12 of the long electrode 0.250 inch and of the short electrode .090 inch. In an electronic timepiece, the switch is utilized in a digital readout circuit in order to conserve battery power, wherein the digital readout can be energized for approximately five seconds after the switch is activitated. Specifically, the opening and reclosing of the switch 10 triggers an electronic timer circuit that activates the digital readout for approximately 5 seconds. In brief, the switch is provided with both a low tilt angle and a force requirement incorporated into one movement, to allow a specific motion to both activate and re-set the switch.

While the present invention has been described in a preferred embodiment, it will be obvious to those skilled in the art that various modifications can be made therein within the scope of the invention, and it is intended that the appended claims cover all such modifications.

What is claimed is:

1. In a tilt-type inertia switch;

a. A chamber having both ends sealed;

b. A first electrode rigidly mounted in one end of said chamber, extending substantially through the axial length of said chamber, slightly tilted downward, and having an end perpendicular to its axial length and cooperating with an inner wall of said chamber to form a closed space therebetween;

c. A second electrode rigidly mounted in said one end of said chamber, extending coaxially therewith for only a portion of the length of said first electrode in a spaced apart relationship therewith and into said closed space;

d. A globule of mercury disposed within said chamber in said closed space formed by the cooperation of the inner wall of said chamber with the perpendicular end of said first electrode whereby said globule of mercury is always in contact with said first electrode and said first electrode exerts surface tension on said globule of mercury and whereby said globule of mercury is always in contact with said second electrode unless a rotational downward force of at least 1.4G is exerted on said switch thereby causing said globule of mercury to break contact with said second electrode thereby opening said switch.

2. The switch of claim 1 wherein said second electrode is formed from a metal chemically inert with respect to mercury and is wetted with mercury whereby said globule of mercury is held to said second electrode regardless of the orientation of said switch with respect to the horizontal unless said rotational downward force of at least 1.4G is exerted on said switch and whereby upon rotation of said switch back towards the horizontal said globule of mercury is caused to flow back toward said second electrode until said switch reaches a point 2° or less below the horizontal at which point said globule of mercury contacts said second electrode thereby closing said switch.

3. The switch of claim 2 wherein said second electrode is made of platinum.

4. The switch of claim 3 in combination with an electronic time-keeping and displaying circuit whereby said rotation of said switch opens the circuit and said rotation back of said switch to 2° or less below the horizontal closes the circuit.

* * * * *

UNITED STATES PATENT OFFICE

CERTIFICATE OF CORRECTION

Patent No. 3,993,882 Dated November 23, 1976

Inventor(s) Robert P. Romano Page 1 of 2

It is certified that error appears in the above-identified patent and that said Letters Patent are hereby corrected as shown below:

The illustrative drawing on the cover sheet, and Fig. 3, should appear as shown on the attached sheet.

Signed and Sealed this

Fifth Day of April 1977

[SEAL]

*Attest:*

RUTH C. MASON
*Attesting Officer*

C. MARSHALL DANN
*Commissioner of Patents and Trademarks*

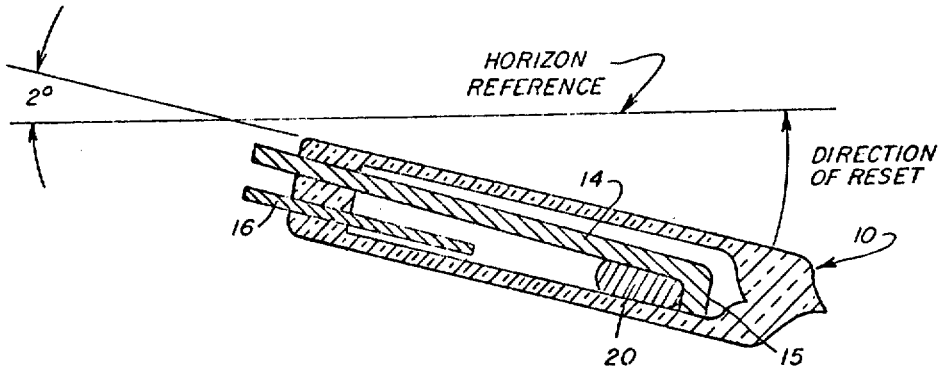
HORIZON
REFERENCE
2°
DIRECTION
OF RESET
14
16
10
20
15